US010329877B2

(12) United States Patent
Simpson et al.

(10) Patent No.: US 10,329,877 B2
(45) Date of Patent: Jun. 25, 2019

(54) DOWNHOLE TOOL AND METHOD

(71) Applicant: Hydralock Systems Limited, Aberdeen, Scotland (GB)

(72) Inventors: Neil Andrew Abercrombie Simpson, Aberdeenshire (GB); Michael Wardley, Aberdeenshire (GB)

(73) Assignee: Hydralock Systems Limited, Aberdeen, Scotland (GB)

( * ) Notice: Subject to any disclaimer, the term of this patent is extended or adjusted under 35 U.S.C. 154(b) by 409 days.

(21) Appl. No.: 14/414,485

(22) PCT Filed: Jul. 15, 2013

(86) PCT No.: PCT/GB2013/051886

§ 371 (c)(1),
(2) Date: Jan. 13, 2015

(87) PCT Pub. No.: WO2014/009756

PCT Pub. Date: Jan. 16, 2014

(65) Prior Publication Data

US 2015/0167427 A1 Jun. 18, 2015

(30) Foreign Application Priority Data

Jul. 13, 2012 (GB) ..... 1212654.6

(51) Int. Cl.
*E21B 34/10* (2006.01)
*E21B 23/04* (2006.01)
*E21B 34/06* (2006.01)

(52) U.S. Cl.
CPC ..... *E21B 34/102* (2013.01); *E21B 23/04* (2013.01); *E21B 34/066* (2013.01)

(58) Field of Classification Search
CPC ..... E21B 34/102
See application file for complete search history.

(56) References Cited

U.S. PATENT DOCUMENTS 2,951,539 A 9/1960 Malone et al.
3,298,441 A 1/1967 Young
5,535,767 A * 7/1996 Schnatzmeyer ..... E21B 23/006 137/1
2002/0049575 A1* 4/2002 Jalali ..... E21B 43/00 703/10
2007/0181298 A1 8/2007 Sheiretov et al.
(Continued)

OTHER PUBLICATIONS

International Search Report & Written Opinion for International Application No. PCT/GB2013/051886 dated Nov. 24, 2014.

*Primary Examiner* — Giovanna C Wright
(74) *Attorney, Agent, or Firm* — Carlson, Gaskey & Olds, P.C.

(57) ABSTRACT

A downhole tool includes a body, a mandrel slidably disposed in the body, a piston for moving the mandrel relative to the body, and a lock having a first configuration which permits movement of the mandrel by the piston and a second configuration which provides a fluid lock across the mandrel which prevents movement of the mandrel by the piston. The lock includes first and second fluid chambers filled with a substantially incompressible fluid and a control valve configurable between an open configuration and a closed configuration, the control valve in the closed configuration providing the fluid lock preventing movement of the mandrel.

23 Claims, 7 Drawing Sheets

(56) References Cited

U.S. PATENT DOCUMENTS

| | | | | |
|---|---|---|---|---|
| 2009/0095490 | A1 | 4/2009 | Moriarty et al. | |
| 2009/0173539 | A1* | 7/2009 | Mock | E21B 44/005 175/25 |
| 2009/0266544 | A1 | 10/2009 | Redlinger et al. | |
| 2010/0270034 | A1* | 10/2010 | Clausen | E21B 23/006 166/383 |
| 2012/0048571 | A1* | 3/2012 | Radford | E21B 10/322 166/373 |
| 2012/0067594 | A1* | 3/2012 | Noske | E21B 34/08 166/373 |
| 2012/0097451 | A1* | 4/2012 | Mock | E21B 44/06 175/50 |

* cited by examiner

DOWNHOLE TOOL AND METHOD

REFERENCE TO RELATED APPLICATION

This application is a United States National Phase application of PCT Application No. PCT/GB2013/051886 filed on Jul. 15, 2013, which claims priority to United Kingdom Application No. 1212654.6 filed on Jul. 13, 2012.

FIELD OF THE INVENTION

This invention relates to a downhole tool and method.

BACKGROUND TO THE INVENTION

In the oil and gas industry, there are a number of drilling, completion and production operations which require the remote operation of downhole tools, devices and equipment using commands or actions carried out at surface.

This can be achieved in numerous ways, perhaps the most common of which is the use of hydraulic pressure generated in the fluid pumped through the drilling or production tubulars to activate a downhole tool or device. In some instances, the pressure of the pumped fluid flow acting across a flow restriction such as a nozzle can be used to apply a force across a piston which in turn activates a tool downhole or device, such as an expandable underreamer, an expandable casing mill, a side port circulating tool or similar device. However, as fluid circulation is required for other operations, such as in the drilling operation itself, it is important that the activation mechanism is selective and can differentiate between the fluid flow required for the drilling process and the fluid flow required to activate the downhole tool or device. In this situation, there are again a number of approaches in current use. For example, tool activation may be achieved by application of a pressure above that required for normal drilling operations, the applied pressure acting on a spring loaded piston. In this example, the downhole tool or device will operate whenever the pressure exceeds a threshold pressure and which is sufficient to overcome the strength of the return spring. Although effective in some applications, this approach has a number of drawbacks. For example, it may not be possible for an operator to obtain a positive indication at surface that the desired activation has taken place. Also, the activation may not be a positive action but happen slowly or partially unless shear pins are employed to ensure that increased pressure is applied above that required to overcome the return spring force. Also, only partial activation may be achieved due to spring tension seal friction and or other factors such as the ingress of mud solids into the moving parts of the system. Also, after activation, the tool will de-activate due to the force of the return spring if and whenever the flow and pressure is reduced below the threshold pressure.

An alternative approach is the use of a ball which is dropped or pumped down from surface so as to land on a ball seat in the piston. The use of a ball may overcome some of the above drawbacks and may provide a relatively simple and low cost activation system. For example, there will be a positive pressure indication when the ball lands on the seat. There will also be a positive activation of the tool when the pressure on the activation piston is sufficient to shear the shear pins holding the tool in the non-activated condition. Also, the flow rate required for activation can be very low. However, these applications too have a number of drawbacks. For example, shear pins permit only a single operation and cannot be replaced until the tool or device is retrieved to surface. Also, the ball introduced at surface will take a considerable time to pump down to the tool or device before activation can take place, this time representing a significant cost to an operator. Also, when located on the seat the ball creates an undesirable restriction in the bore which may inhibit or prevent the passage of other tools. Repeat operations may also not be possible with the more basic systems.

As a further alternative to the techniques described above, more complex systems are currently being used in the industry which involve dropping a number of sequential balls or darts into the bore to land on a deformable ball seat or releasing mechanism mounted within a sprung loaded actuation piston. After actuation, the balls or darts may be released to be caught in a catcher or holder below the tool or device. These systems beneficially allow a number of repeat operations to be carried out but in some situations can be unreliable. They may also still suffer many of the disadvantages described above.

More recently, RFID (Radio Frequency Identification) tags have been used to transfer instructions to a tool or device to be activated as the RFID tag is pumped through it. The use of RFID tags permits a high number of repeat operations to be carried out and permits more sophisticated instructions to be communicated to the tool being activated, including the ability to differentiate between a number of downhole tools. The use of RFID tags may also overcome the problem of bore restriction associated with drop ball techniques. Nevertheless, this approach represents a comparatively complex and costly solution which requires sophisticated downhole electro-mechanical actuation systems to operate.

SUMMARY OF THE INVENTION

Aspects of the present invention relate to the use of a fluid lock to control actuation or operation of downhole tools and equipment.

According to a first aspect of the present invention, there is provided a downhole tool including a body, an actuation member moveable relative to the body, an actuation arrangement configured to move the actuation member relative to the body, and a lock configured in a first configuration to permit movement of the actuation member by the actuation arrangement and configured in a second configuration to provide a fluid lock across the actuation member which prevents movement of the actuation member by the actuation arrangement.

The downhole tool may include an actuator for performing a downhole operation. The downhole tool may be integrally formed one or more downhole tool or device to be controlled or may be configured to engage and control actuation of said one or more associated downhole tool or device to be controlled. For example, the downhole tool may define a lock module or lock sub coupled to the downhole tool or device to be controlled. Any suitable means for engaging the associated downhole tool or device to be controlled may be utilised. The actuation member of the downhole tool may be configured for direct attachment to, or otherwise configured to directly engage, the actuation mechanism or systems of the tool or device to be controlled. By way of example, the actuation member of the downhole tool may be utilised with a biasing piston or the like to move a sliding sleeve or other type of valve system to allow drill string pressure to act on the actuation piston or operating components of the tool or device to be controlled. Alternatively, or additionally, the actuation member of the downhole tool may be used with a biasing piston or the like to release and or re-apply a mechanical sear or trigger mechanism to pull a supporting sleeve from a finger collet type locking system or the like.

Beneficially, embodiments of the present invention may provide a downhole tool for selectively actuating or operating an associated downhole tool or device and which is simple, reliable, is capable of real time activation, is selectively isolated from normal pumping flow and pressure requirements, and which permits the passage of further downhole tools, devices or equipment through the tool and does not require additional elements such as balls, darts or RFID tags to be pumped from surface to operate.

Providing a selective fluid lock across the actuation member may permit the actuation member to be locked or held in place at any required position or stage of operation and for any required time interval. Since the actuation member is incapable of movement while the fluid lock is in place, the tool can be isolated from pressures, such as normal pumping flow and other pressure events, or other forces in the bore which may otherwise act on the actuation member.

The downhole tool may be operable between a retracted configuration and an extended configuration. The downhole tool may be configured so that movement of the actuation member from the retracted configuration to the extended configuration performs, or permits performance of, a downhole operation. For example, movement of the actuation member from the retracted configuration to the extended configuration may apply a push force to an associated tool or device. Alternatively, or additionally, the downhole tool may be configured so that movement of the actuation member from the extended configuration to the retracted configuration performs, or permits performance of, a downhole operation. For example, movement of the actuation member from the extended configuration to the retracted configuration may apply a pull force to an associated tool or device.

The lock may be of any suitable form and construction.

The lock may be configured to retain the actuation member in the retracted configuration. The lock may be configured to retain the actuation member in the extended configuration. The lock may be configured to retain the actuation member in one or more intermediate position between the retracted configuration and the extended configuration.

The lock may be separate from and/or isolated from the actuation arrangement. The lock may comprise a closed fluid system.

The tool may include a first fluid chamber. The first fluid chamber may include an annular chamber. The tool may include a second fluid chamber. The second fluid chamber may include an annular chamber.

The lock may be configured in the first configuration to permit fluid communication between the first fluid chamber and the second fluid chamber (that is, from the first fluid chamber to the second fluid chamber or vice-versa) and configured in the second configuration to prevent fluid communication between the first fluid chamber and the second fluid chamber. By preventing fluid communication between the first fluid chamber and the second fluid chamber, the fluid lock may be created across the actuation member to lock the actuation member and prevent movement of the actuation member by the actuation arrangement.

The first fluid chamber and the second fluid chamber may be configured to receive a fluid. The fluid may include a hydraulic fluid, such as hydraulic oil or other suitable fluid. Providing a substantially incompressible fluid in a closed fluid system permits the fluid lock to be created across the actuation member in use.

A fluid communication arrangement may communicate the fluid between the first fluid chamber and the second fluid chamber. The fluid communication arrangement may be of any suitable form and construction. The fluid communication arrangement may include at least one fluid passage or gallery. At least part of the fluid communication arrangement may be formed or otherwise provided in the body. Alternatively, or additionally, at least part of the fluid communication arrangement may include a fluid conduit, such as a hydraulic line or the like.

The lock may include a valve. In use, the valve may be movable between an open condition and a closed condition to selectively permit fluid communication between the first fluid chamber and the second fluid chamber.

The valve may be of any suitable form and construction.

The valve may include a control valve.

The valve may be logic controlled.

In some embodiments, the valve may include an electromechanical valve.

The valve may include a pilot valve. The valve may include a solenoid valve. In particular embodiments, the valve may include single coil piloting solenoid valve or the like.

In other embodiments, the valve may include a hydraulic valve, or valve arrangement or the like.

The hydraulic valve arrangement may be of any suitable form and construction. The hydraulic valve arrangement may include an actuating arrangement. The hydraulic valve actuating arrangement may include a piston. The hydraulic valve actuating arrangement may include a first fluid chamber and a second fluid chamber. The first chamber may communicate with annulus pressure. The second chamber may communicate with throughbore or string pressure within the downhole tool. The hydraulic valve actuating arrangement may include a biasing member, such as a spring. In use, changes in the differential pressure between throughbore pressure and annulus pressure may act on the piston to translate the piston. In particular embodiments, the hydraulic valve actuating arrangement may be operable at a significantly lower pressure than that used to operate the system that it controls.

The hydraulic valve arrangement may include a linear return and delay arrangement. The linear return and delay arrangement may include a piston and cylinder arrangement. The piston and cylinder arrangement may include a piston disposed within an oil-filled cylinder. The linear return and delay arrangement may be configured so that the piston has a slow stroke and fast stroke. In particular embodiments, the linear return and delay arrangement may be configured so that the piston has a slow outward stroke and fast return stroke. The linear return and delay arrangement include a choke or fluid restriction device. In use, the choke or fluid restriction device may control or provide the slow outward stroke. The linear return and delay arrangement include a non-return valve. In use, the non-return valve may control or provide the fast return stroke.

The hydraulic valve arrangement may include a cam arrangement. The cam arrangement may include a rotating cam arrangement. In particular embodiments, the cam arrangement may include a rotating j slot cam. The cam arrangement may include or define a plurality of paths. The cam arrangement may include or define a short stroke and a long stroke.

The hydraulic valve arrangement may include pilot valve. The pilot valve may be of any suitable form and construction. In particular embodiments, the pilot valve may include a spool type pilot valve. The pilot valve may permit selective communication between the first fluid chamber of the downhole tool and the second fluid chamber of the downhole tool.

The hydraulic valve arrangement may be configured to provide for a short cycle in a closed position and a long stroke in an open position.

The body may be of any suitable form and construction.

The body may have a throughbore. The actuation member may be disposed in the body throughbore.

The body may include a unitary component. In particular embodiments, the body may include a modular body.

The tool may form part of a downhole tool string. A connection arrangement may be provided for coupling the downhole tool to other components of the tool string. The connection arrangement may include threaded connectors, such as a threaded box and pin connectors.

The actuation member may be of any suitable form and construction. The actuation member may include a mandrel. The actuation member may include a piston. The actuation member may include a double acting piston. The actuation member may include an axial passage or throughbore. The tool may be configured so that the throughbore permits the passage of an object, for example but not exclusively a downhole tool, therethrough.

The tool may be configured to activate the fluid lock in response to a selected activation event. The activation event may be of any suitable form.

The activation event may include an activation signal. The activation signal may be transmitted from surface.

The activation event may, for example, include a sequence of pressure changes in a particular time interval. The downhole tool may include one or more pressure sensor or transducer. By way of example, the activation event may include a sequence of turning fluid pumps at surface on and off in a predetermined sequence over a predetermined time interval. Any sequence or time interval may be used, as appropriate.

Alternatively or additionally, the activation event may include or involve a movement, for example but not exclusively a movement of the tool string. The downhole tool may include one or more movement sensor, accelerometer or the like. In particular embodiments, the accelerometer may include a tri-axial accelerometer. In use, the downhole tool may be configured to interpret a sequence of movement as opposed in order to actuate.

Alternatively or additionally, the activation event may include a mud pulse or the like.

The activation event may correspond to a selected activation command for the downhole tool and the downhole tool may be configured to carry out the activation command in response to the activation event. By way of example, but not exclusively, the downhole tool may be configured to unlock for a period of one minute, three minutes, five minutes or ten minutes on receipt of a particular activation signal.

The downhole tool may include a control system for interpreting the or each activation signal.

The downhole tool may include a communication arrangement for communicating with surface. The communication arrangement may be configured to receive the activation event. The communication arrangement may additionally be configured to transmit information to surface.

The downhole tool may include an onboard power supply. The onboard power supply may include a battery or battery pack. In particular embodiments, the tool may be configured so that the onboard power supply need only supply power to the lock. Beneficially, it will be recognised that the lock may require a comparatively little amount of power to operate since the lock may not itself actuate the actuation member, this being operated by the actuation arrangement of the downhole tool. The downhole tool may alternatively or additionally receive at least some power from surface.

The actuation arrangement may be of any suitable form and construction.

The actuation arrangement may include a piston. The actuation arrangement may be moveable relative to the body in response to a fluid pressure in the throughbore. Alternatively or additionally, the actuation arrangement may be moveable relative to the body in response to a fluid pressure in a bore annulus.

The actuation arrangement may be directly coupled to the actuation member. Alternatively, the actuation member may be operatively coupled to the actuation member.

The tool may include a biasing member, such as a spring. The biasing member may be operatively associated or form part of the actuation arrangement. In use, the biasing member may be configured to bias the actuation member to a retracted position.

According to a second aspect of the present invention, there is provided a method including disposing a downhole tool is a bore, the downhole tool including a body, an actuation member moveable relative to the body, an actuation arrangement configured to move the actuation member relative to the body, and a lock, and the method including the step of activating the downhole tool from a first configuration to a second configuration, wherein in the first configuration the tool permits movement of the actuation member by the actuation arrangement and wherein in the second configuration the tool provides a fluid lock across the actuation member which prevents movement of the actuation member by the actuation arrangement.

The downhole tool may be activated in response to an activation event, in particular but not exclusively a predetermined activation event from surface.

It should be understood that the features defined above in accordance with any aspect of the present invention or below in relation to any specific embodiment of the invention may be utilised, either alone or in combination, with any other defined feature, in any other aspect of the invention.

BRIEF DESCRIPTION OF THE DRAWINGS

These and other aspects of the present invention will now be described by way of example with reference to the drawings, of which.

DETAILED DESCRIPTION OF THE DRAWINGS

Figure 1:
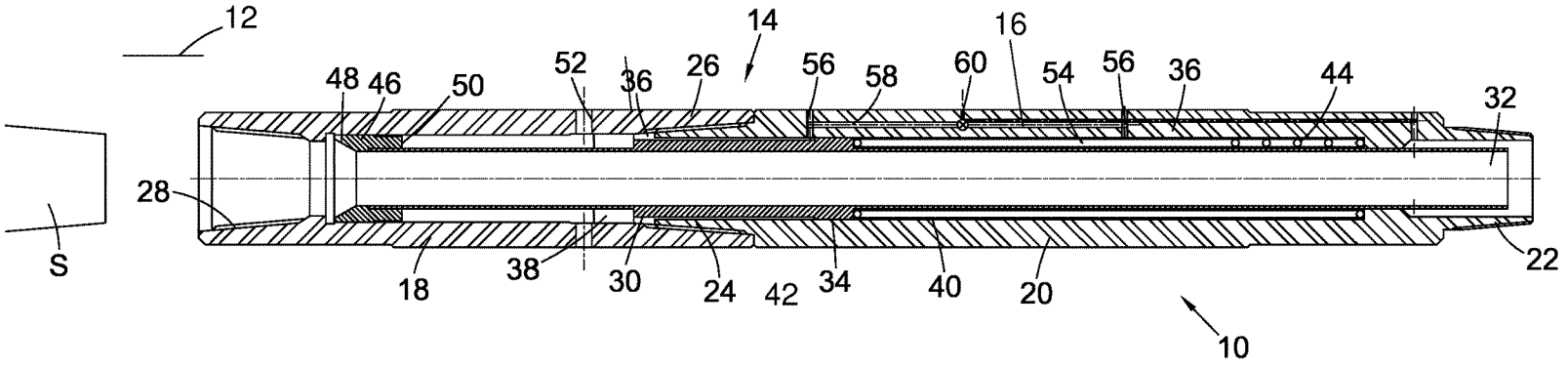
FIG. 1 shows a longitudinal section view of a downhole tool according to a first embodiment of the present invention, the tool shown in a retracted configuration.
Figure 2:
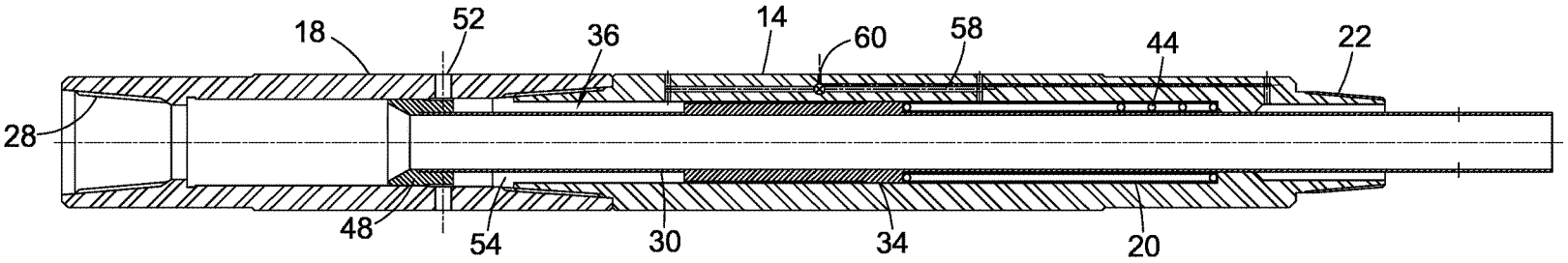
FIG. 2 shows a longitudinal section view of the downhole tool shown in FIG. 1, shown in an extended configuration.

Referring first to FIGS. 1 and 2, there is shown a downhole tool 10 according to a first embodiment of the present invention, shown located in a bore 12. FIG. 1 shows the downhole tool 10 in a retracted configuration while FIG. 2 shows the downhole tool 10 in an extended configuration.

As shown in FIGS. 1 and 2, the tool 10 includes an annular body 14 having a throughbore 16. In the illustrated embodiment, the body 14 is modular in construction and includes loading bearing upper and lower subs 18, 20. However, it will be understood that the body 14 may alternatively include a unitary component. A threaded pin connector 22 is provided at a downhole end (to the right as shown in the figures) of the lower sub 20 for coupling the tool 10 to an associated tool or component. A threaded pin connector 24 is provided at an uphole end (to the left as shown in the figures) of the lower sub 20 for coupling to a threaded box connector 26 provided at the downhole end of the upper sub 18. A threaded box connector 28 is provided at an uphole end of the upper sub 18 for coupling the tool 10 to an uphole tool or component. In use, the tool 10 may form part of a downhole tool string S, the tool 10 run into the bore 12 with the string S and operable to actuate an associated downhole tool.

A central mandrel 30 is slidably disposed in the body 14 and forms an actuation member of the tool 10. The mandrel 30 is tubular in construction having an axial throughbore 32 which allows for the free circulation of fluid and the passage of smaller tools and equipment (not shown) through the tool 10.

A central portion of the mandrel 30 defines a stepped and radially extending lock piston 34 disposed in a recess 36 in the body 14. In the illustrated embodiment, a downhole end of the recess 36 is defined by a portion of the lower sub 20 and an uphole end of the recess 36 is defined by a cap ring 38 secured within the upper sub 18. The cap ring 38 facilitates assembly of the tool 10 by permitting the mandrel 30 to be located in the recess 36.

The piston 34 sealingly engages the body 14 such that first and second fluid chambers 40, 42 are defined between the mandrel 30 and the body 14. A spring 44 is disposed in the first fluid chamber 40 and acts upon the piston 34, the spring 44 biasing the piston 34 and the mandrel 30 towards the retracted configuration as shown in FIG. 1.

The tool 10 further includes an actuating piston 46 and, in use, the actuating piston 46 forms an actuation arrangement of the tool 10. In the illustrated embodiment, the actuating piston 46 includes a separate component coupled around an upper end of the mandrel 30, although the actuating piston 46 could alternatively be formed by the mandrel 30. As shown in FIGS. 1 and 2, the actuating piston 46 sealingly engages the body 14 and has an upper end face 48 which is exposed to flow and pressure in the throughbore 16 and a lower end face 50 which is exposed to annulus flow and pressure via a port 52 in the body 14. In use, differential pressure acting across the larger area of the upper end face 48 of the actuating piston 46 urges the actuating piston 46 and the mandrel 30 towards the extended configuration as shown in FIG. 2.

Thus, where there is a positive pressure difference between the throughbore 16 and the annulus which exceeds the spring force, for example when fluid is circulating in the well during drilling, the actuating piston 46 urges the mandrel 30 towards the extended configuration. Where the pressure differential is insufficient to overcome the spring force, for example where there is no circulation, the spring 44 urges the mandrel 30 towards the retracted configuration.

As shown in FIGS. 1 and 2, the first and second fluid chambers 40, 42 are filled with a substantially incompressible fluid, such as hydraulic fluid or oil 54, via fill ports 56 and a fluid communication arrangement is provided to permit fluid communication between the chambers 40, 42. In the embodiment shown in FIGS. 1 and 2, the fluid communication arrangement includes galleries 58 formed in the body 14, although any suitable communication arrangement may be used where appropriate.

A control valve 60 is disposed in the galleries 58, the control valve 60 configurable between an open configuration and a closed configuration and it will be recognised that the chambers 40,42, galleries 58 and control valve 60 define a closed fluid system, such that when the control valve 60 is in the closed configuration a fluid lock is formed which prevents movement of the mandrel 30.

Thus, in use, opening the control valve 60 releases the fluid lock and allows the activating piston 46 to move against the return spring 44 when flow and pressure are applied, in turn activating the associated tool or equipment being controlled by the actuation tool 10 while closing the control valve 60 reapplies the fluid lock locking the actuation tool 10 and the tool or device that it is controlling in its activated or deactivated state. Beneficially, the ability to selectively provide a fluid lock permits the tool 10 and any pressure operable tools or equipment operatively associated with the tool 10 to be isolated from variations in flow and pressure which occur in the bore.

In the illustrated embodiment, the control valve 60 includes an electro-mechanical control valve in the form of a single coil piloting solenoid valve.

Figure 3:
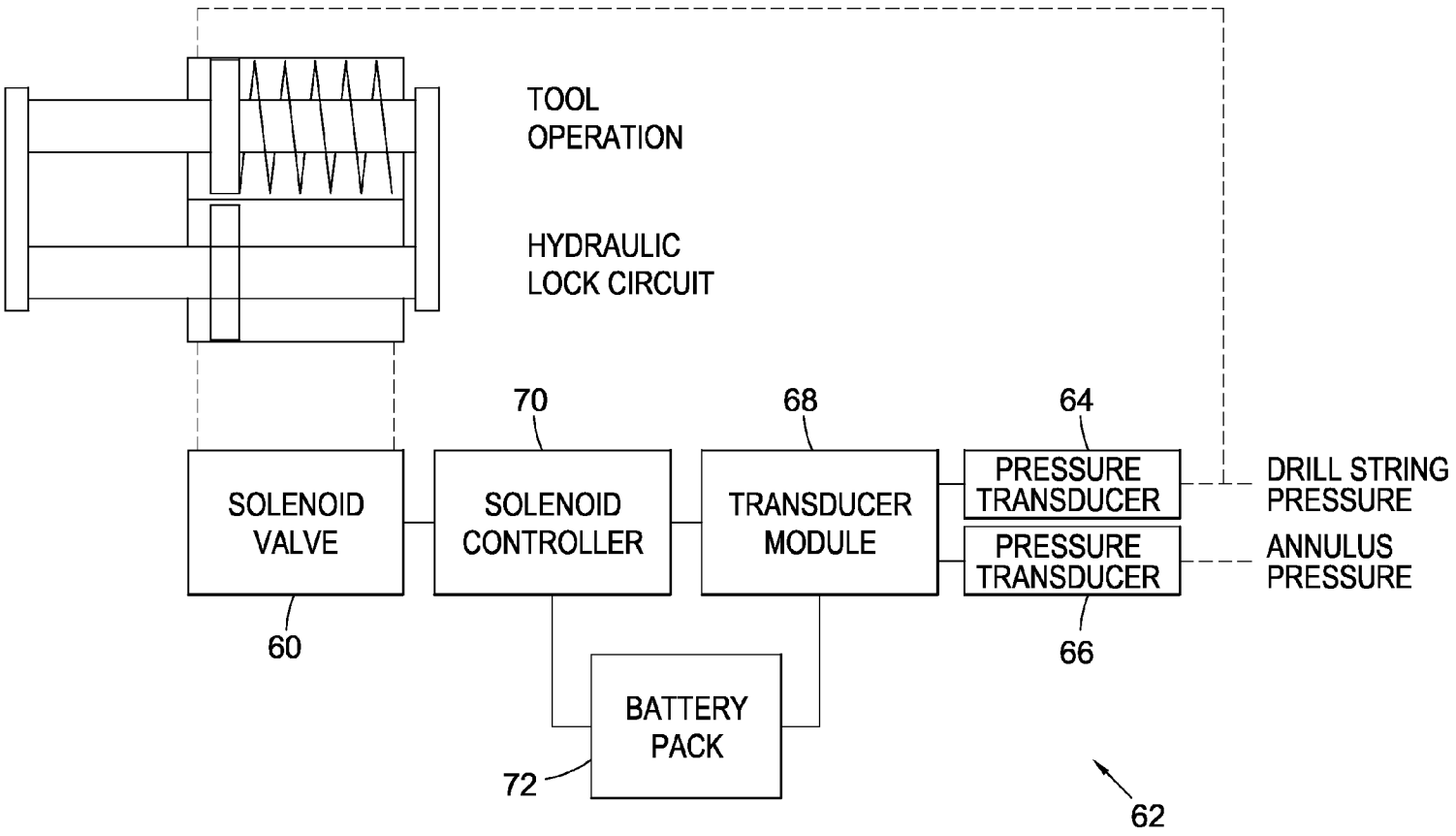
FIG. 3 shows a schematic view of a control system for use in embodiments of the present invention.

The tool 10 further includes a control system 62 for controlling the condition of the valve 60 and thus fluid flow between the first and second chambers 40, 42 and an exemplary control system 62 is shown schematically in FIG. 3.

As shown in FIG. 3, the control system 62 includes a first pressure transducer 64 communicating with pressure in the throughbore and a second pressure transducer 66 communicating with pressure in the annulus. A transducer module 68 communicates with the first and second pressure transducers 64, 66 and a solenoid controller 70. The solenoid controller 70 controls the valve 60. A battery pack 72 is also provided to supply power to the transducer module 68 and the solenoid controller 70.

In use, the transducer module 68 senses pressure changes taking place in the fluid being pumped through the tool 10, activating the valve 60 only when it sees a predetermined sequence of pressure changes occurring over a specific period. It is envisaged that the valve 60 will be opened, and the fluid lock released, for a predetermined time period sufficient to actuate the tool 10 to enable the tool 10 in turn to activate the associated downhole equipment. After this time period, the fluid lock is reapplied and the tool 10 locked.

Embodiments of the present invention may be used in a number of different downhole applications. For example, in conventional drilling operations it is periodically necessary to make a connection, that is to add lengths of drilling tubulars to a drill string to enable drilling to continue. In such an operation, the existing drill string is hung off the drill floor at surface by means of slips and the threaded connection at the drill floor broken and unscrewed to permit the new connection to be made. At this stage in the operation, the pumps which normally direct fluid through the drilling tubulars for the drilling operation are shut down and fluid circulation stopped. A new length of drilling tubular is threadedly connected to the drill string and the connections made fluid tight, the pumps then being restarted. The slips are removed and the string of drilling tubulars lowered back in the borehole to continue the drilling operation. It will be recognised that this process involves fluid circulation in the bore being stopped, typically for several minutes, each time a new connection is made, each resulting in variations in pressure and flow downhole. Whereas conventional actuation mechanisms may be detrimentally affected by these changes in pressure and flow, in embodiments of the present invention the control system 62 of the downhole tool 10 can interpret the changes in pressure and determine whether these represent a normal event which requires no action. On detecting a specified actuation event, however, such as a specific series of pressure changes in a unit period of time, the control system 62 is configured so transmit a control current to the valve 60 to release the fluid lock for a specified period and thus provide an operational window for actuation of the tool 10 and associated equipment, after which the fluid lock is re-applied. By way of example, an operator may start and stop the pumps three times within a period of one minute, the control system 62 of the tool 10 recognising this as a particular actuation event corresponding to an instruction to activate the tool 10 to release the fluid lock for period of three minutes. Starting the pumps would not trigger the control system 62.

It will be recognised that embodiments of the present invention may be utilised in conjunction with a wide variety of downhole tools and equipment.

Figure 4:
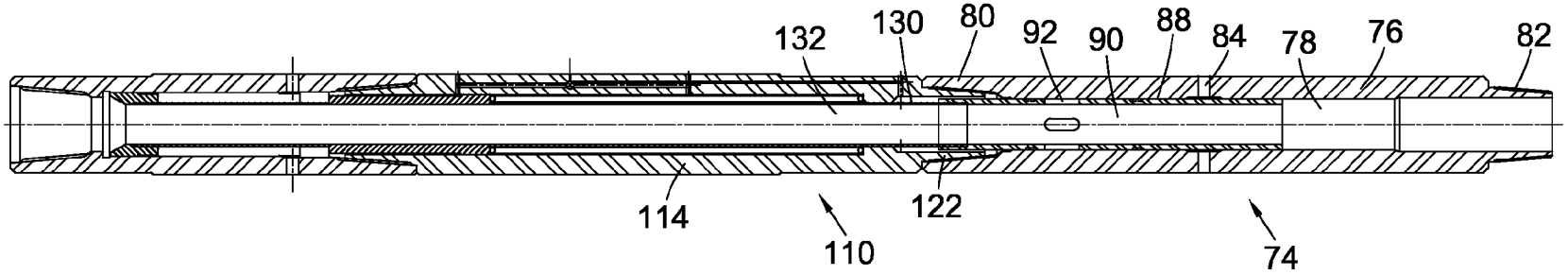
FIG. 4 shows a longitudinal section view of a downhole tool according to a second embodiment of the present invention, the tool shown in a retracted configuration.
Figure 5:
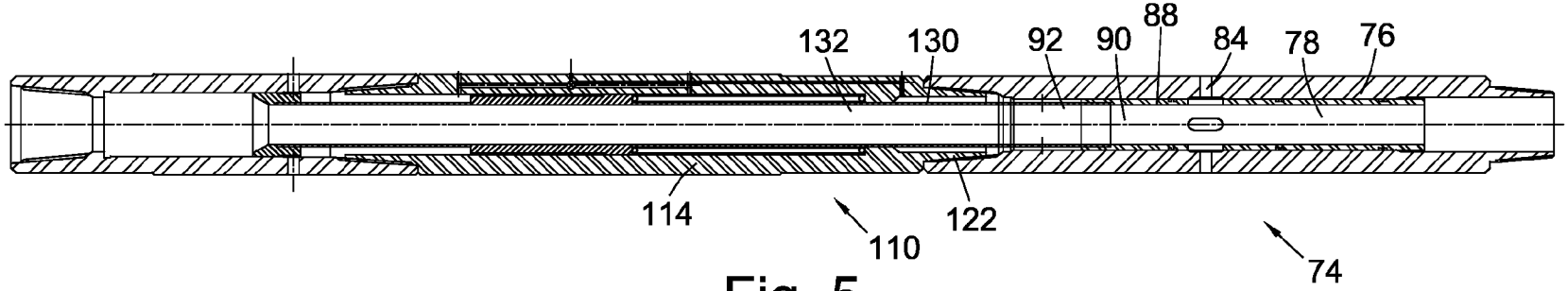
FIG. 5 shows a longitudinal section view of the downhole tool shown in FIG. 4, the tool shown in an extended configuration.

By way of example, FIGS. 4 and 5 show a downhole tool 110 according to a second embodiment of the present invention. The downhole tool 110 is similar to the tool 10 described above and like components are represented by like reference signs incremented by 100. In this embodiment, the tool 110 is coupled to, and configured to operate, an associated downhole tool in the form of a side port circulation sub 74.

As shown in FIGS. 4 and 5, the circulation sub 74 includes a tubular body 76 having a throughbore 78, a threaded box connector 80 at its uphole end for coupling to pin connector 122 of body 114 of tool 110, and a threaded pin connector 82 at its downhole end. One or more lateral flow passage or port 84 is provided through the body 76 and a sliding sleeve 88 having a throughbore 90, and which in the illustrated embodiment also includes a flow passage or port 92, is disposed within the body 76.

As shown, a distal downhole end of mandrel 130 of tool 110 is configured to engage the uphole end of the sliding sleeve 88, the sliding sleeve 88 and mandrel 130 coupled so that the throughbore 90 and mandrel throughbore 132 are contiguous. In use, movement of the mandrel 130 from the retracted configuration shown in FIG. 4 to the extended configuration shown in FIG. 5 moves the sliding sleeve 88 relative to the body 76 to align the ports 84, 92 and permit fluid communication between the throughbore 90 and the annulus (or vice-versa).

Figure 6:
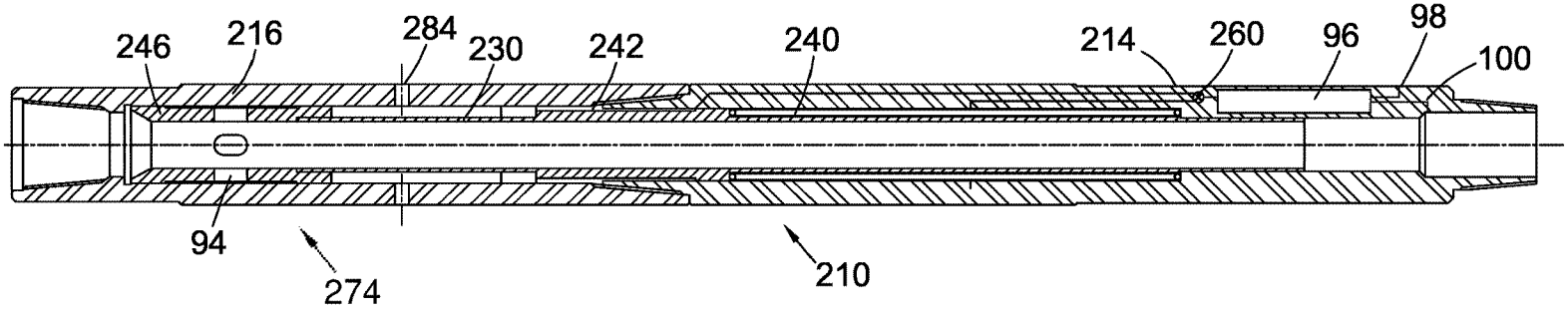
FIG. 6 shows a longitudinal section view of a downhole tool according to a third embodiment of the present invention, the tool shown in a retracted configuration.
Figure 7:
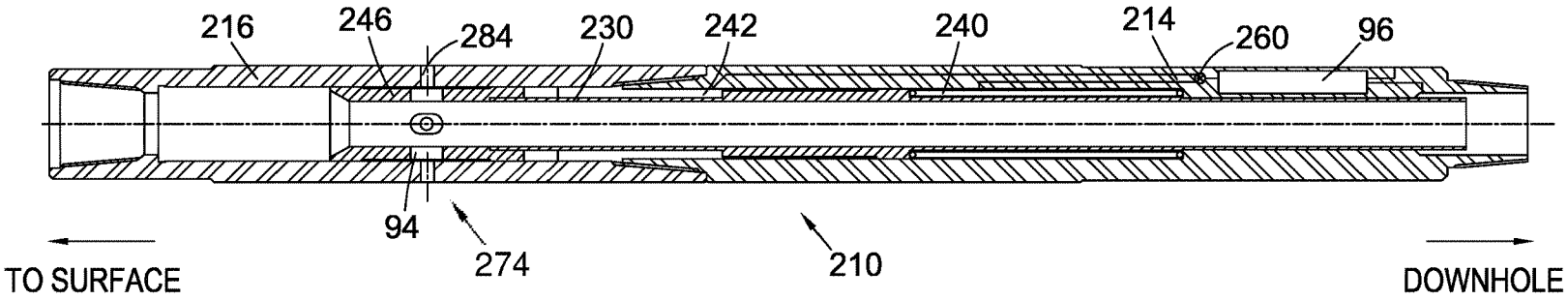
FIG. 7 shows a longitudinal section view of the downhole tool shown in FIG. 6, the tool shown in an extended configuration.
Figure 8:
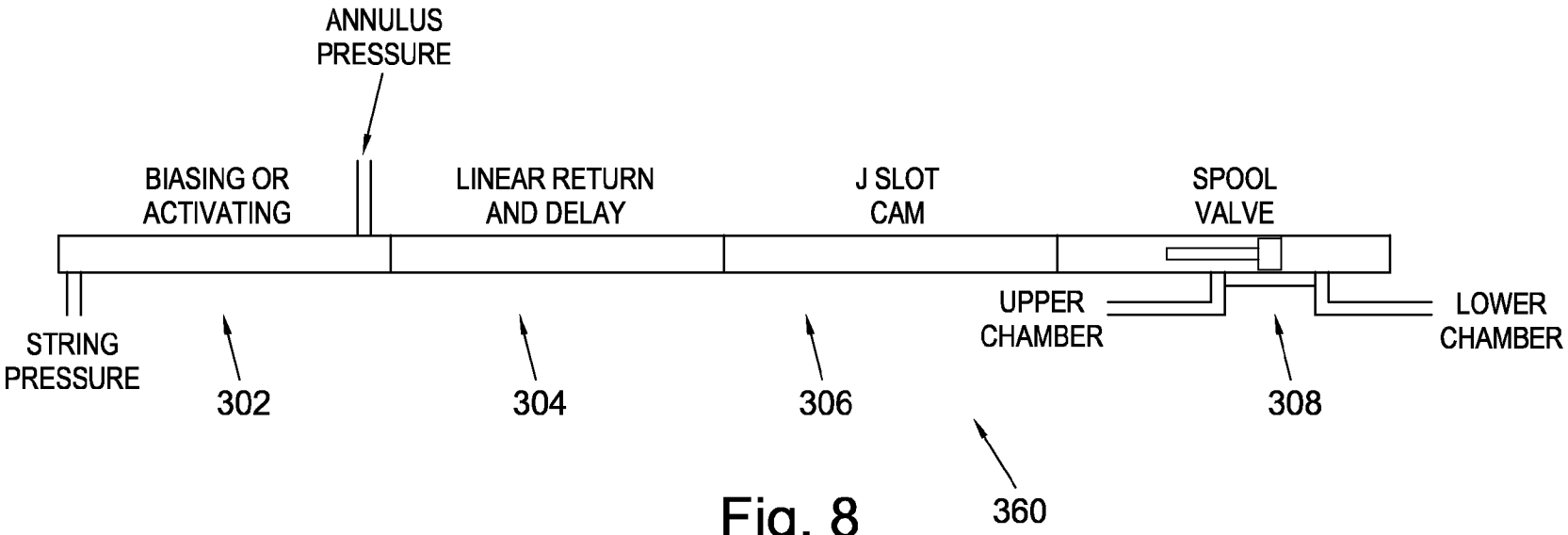
FIG. 8 shows a schematic view of a hydraulic control valve arrangement according to an embodiment of the present invention.

In the embodiment shown in FIGS. 4 and 5, the tool 110 and side port circulation sub 74 include separate tools coupled together, however it will be understood that the tool and associated downhole tool and equipment may be integrally formed where appropriate. For example, FIGS. 6 and 7 show a downhole tool 210 according to a third embodiment of the present invention. The downhole tool 210 is similar to the tools 10, 110 described above and like components are represented by like reference signs incremented by 200. In this embodiment, the tool 210 is integrally formed with side port circulation tool 274.

As shown in FIGS. 6 and 7, the tool 210 of this embodiment differs from the tools 10, 110 in that the upper sub 216 and actuation piston 246 each include a lateral flow passage or port 284, 94. In use, movement of mandrel 230 from the retracted configuration shown in FIG. 6 to the extended configuration shown in FIG. 7 aligns the ports 284, 94 and permits fluid communication between the throughbore 232 and the annulus (or vice-versa).

This embodiment also differs in that the fluid communication arrangement includes hydraulic transfer lines in place of the galleries to communicate fluid between the chambers 240, 242. In this embodiment, control valve 260 communicates with a battery and electronics module 96, an annular pressure line 98 and a bore pressure line 100 which are disposed within body 214.

It should be understood that the embodiments described herein are merely exemplary and that various modifications may be made thereto without departing from the scope of the invention.

For example, while the embodiments described above describe the use of a electro-mechanical control valve, in other embodiments the control valve may include a hydraulic valve arrangement.

An exemplary hydraulic control valve arrangement 360 according to an embodiment of the present invention is shown in FIGS. 8 to 11. In the illustrated embodiment, the valve arrangement 360 includes a hydraulic control pilot valve having four basic stages or modules 302, 304, 306, 308.

Figure 9:
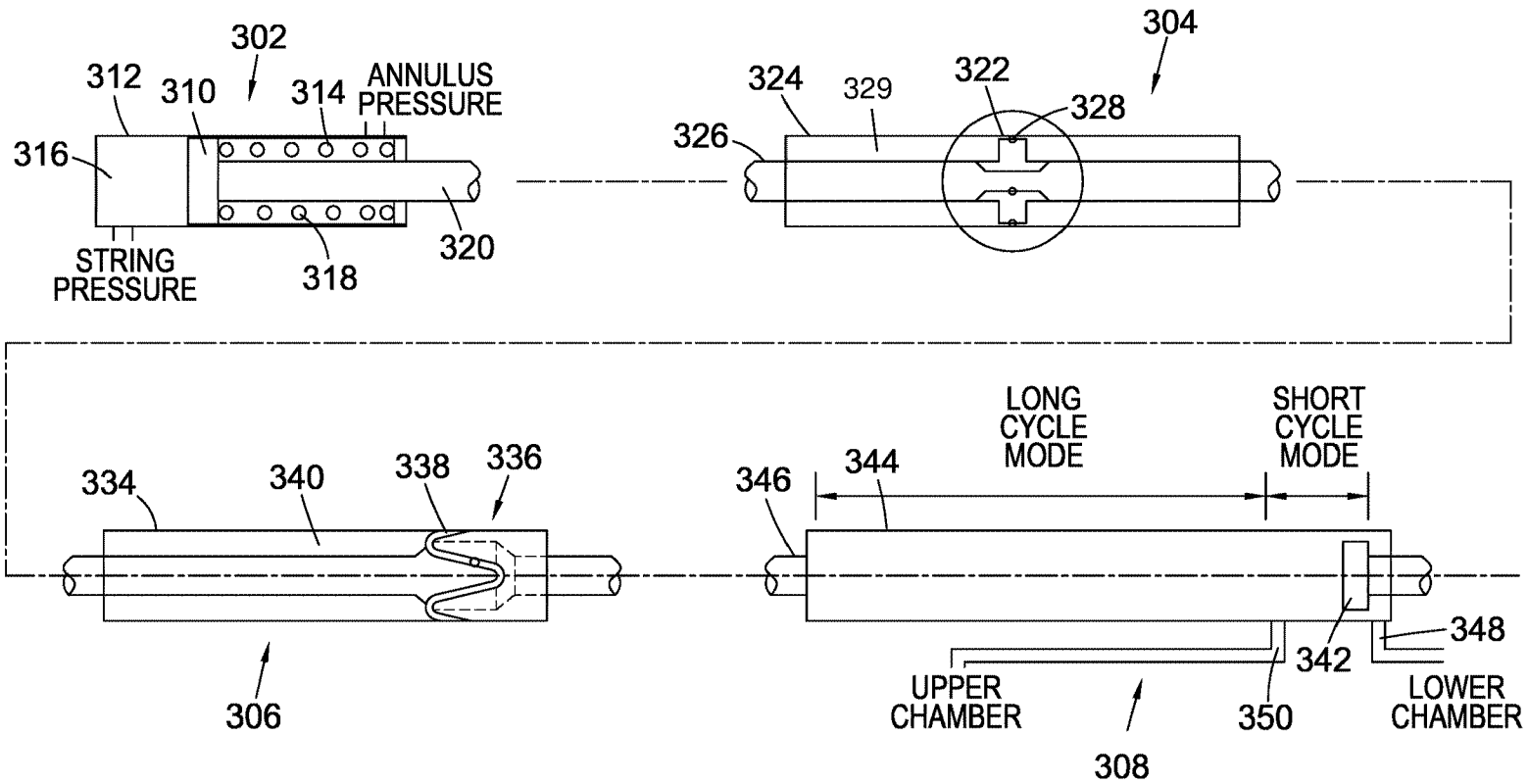
FIG. 9 shows diagrammatic views of first, second, third and fourth modules of the hydraulic control valve arrangement shown in FIG. 8.
Figure 10:
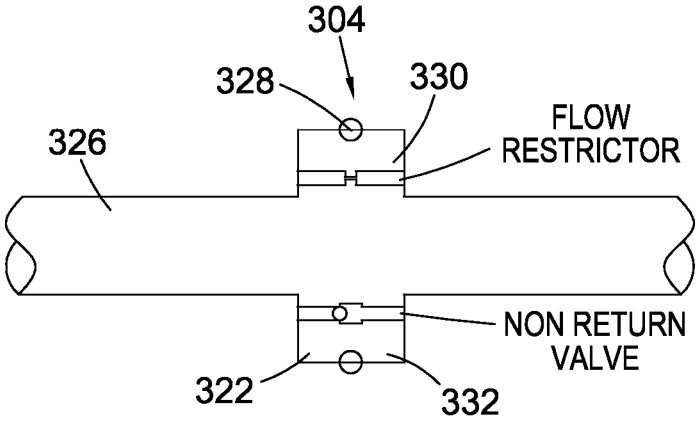
FIG. 10 shows an enlarged view of part of the second module of the hydraulic control valve arrangement shown in FIG. 8.
Figure 11:
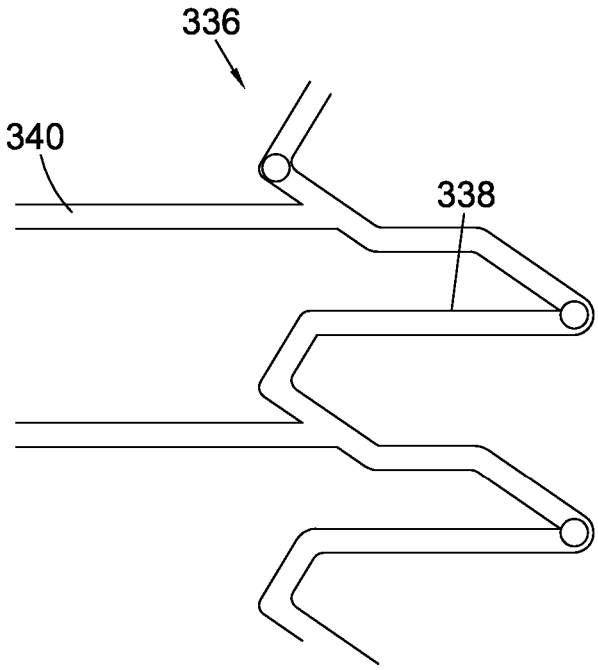
FIG. 11 shows an enlarged view of part of the third module of the hydraulic control valve arrangement shown in FIG. 8.

The first module 302 of the hydraulic control valve arrangement 360 includes a biasing or actuating module having a piston 310 disposed within a body 312, the piston 310 defining a first fluid chamber 314 and a second fluid chamber 316 in the body 312. As shown in FIG. 9, the first chamber 314 communicated with annulus pressure and the second chamber communicates with throughbore or string pressure within the downhole tool. In the illustrated embodiment, a return spring 318 is disposed in the first chamber 314 to ensure piston return, although in other embodiments the spring may not be required. In use, changes in the differential pressure between throughbore pressure and annulus pressure act on the piston 310 to translate a piston rod 320 coupled to the second module 304, which will be described further below. In particular embodiments, the first module 302 is operable at a significantly lower pressure than that used to operate the system that it controls.

The second module 304 of the hydraulic control valve arrangement 360 includes a linear return and delay module having a piston 322 disposed within a body 324 and secured to a piston rod 326. A seal 328 is disposed on the piston 322 between the piston 322 and the body 324, such that the piston 322 defines an oil filled cylinder 329 in the body 324. The second module 304 is configured so that the piston rod 326 has a slow outward stroke (to the right as shown in the figures) and fast return stroke (to the left as shown in the figures). The slow outward stroke is controlled by a choke or fluid restriction device 330. The fast return stroke is controlled by a non-return valve 332.

The third module 306 of the hydraulic control valve arrangement 360 includes a cycling cam module having a cylindrical housing 334 containing a rotating j slot cam 336 defining two cycle modes in use: a short stroke 338 and a long stroke 340.

The fourth module 308 of the hydraulic control valve arrangement 360 includes a spool type pilot valve module having a piston 342 disposed within a body 344 on piston rod 346 and ports 348, 350. Port 348 communicates with the first fluid chamber of the downhole tool and port 350 communicates with the second fluid chamber of the downhole tool. In use, translation of the piston 342 controls the opening and closing of the ports 348, 350 to selectively provide fluid communication between the first and second fluid chambers of the downhole tool. The module 308 is arranged so to provide for a short linear cycle in a closed position and a long stroke in an open position.

With the downhole tool in an initial closed configuration, the action of stopping and starting the surface pumps at a time interval associated with a normal event, such as making a connection, will bias the piston 310 to move backwards and forwards as circulating pressure is reduced to zero and increased back to a reduced or normal circulating rate. By virtue of the interconnected piston rods, the second module 304 ensures that the rods of the first, third and fourth modules 302, 306, 308 move relatively slowly on their outward stroke and relatively fast on their return stroke. In the illustrated embodiment, the outward stroke takes approximately one minute while the return stroke takes only a few seconds. In this configuration, the pilot valve piston is in closed position, the piston 342 moving backwards and forwards between the ports 348, 350.

If the surface pumps are started and stopped at a time interval associated with an actuation event, for example where the pumps are started and then shut down within a period of thirty seconds, then the cycling cam 336 of the third module 306 will move to the long stroke mode where it allows the piston of the piloting spool valve module 308 to move a longer distance over a relatively short period of time, this assisted by the non-return valve 332 in the second module 304. This action exposes both of the ports 348, 350 and permits fluid communication between the first and second fluid chambers of the downhole tool, thus releasing the fluid lock.

The second module 304 permits the cycling cam 336 to move back to the short stroke position over a relatively long time period, at which point the ports 348, 350 between the upper and lower chambers are once more blocked and the fluid lock reengaged.

Since the hydraulic control valve arrangement 360 is operable at a significantly lower pressure differential than the main actuation mechanism, it is possible to have the ports 348, 350 open for several minutes at high pressure differential when activating associated downhole equipment or open for several minutes at low pressure differential when deactivating associated downhole equipment.

An exemplary sequence of operation for activating a downhole tool or device is described below:—

1. stop the pumps and allow pressure to drop to zero (which will allow the j slot cam to move quickly to the lower position);

2. start the pumps at reduced rate for 30 seconds then stop them (which will allow the j slot cam to move slowly up the j slot to a position beyond the entry into the long stroke section and once the pumps are stopped move quickly back to enter the long stroke section);

3. wait thirty seconds for the j slot cam to move down the long stroke mode (which will open the ports between the upper and lower chambers releasing the hydraulic lock);

4. start the pumps at normal circulating rate (high differential pressure) for 6 minutes, to activate the downhole tool or device, during which time the flow restrictor in the linear return and delay mechanism will delay closure of the ports between the upper and lower chambers of the hydraulic locking mechanism;

5. after 10 minutes at normal circulating rate the j slot cam will have moved slowly back to the short stroke position where the ports to the upper and lower chambers are in the closed position.

The tool is now in activated locked position and will remain locked even with repeated pump stops and starts for single joint changes or other reasons, provided that the sequence of starting pumps and stopping them inside 1 minute is not repeated, (in this state the j slot will cycle in the short stroke mode).

An exemplary sequence of operation for activating a downhole tool or device is described below:

1. stop the pumps and allow pressure to drop to zero (which will allow the j-slot cam to move quickly to the lower position);

2. start the pumps at reduced rate for 30 seconds then stop them (which will allow the j-slot cam to move slowly up the j-slot to a position beyond the entry into the long stroke section and once the pumps are stopped move quickly back to enter the long stroke section);

3. wait 30 seconds for the j slot cam to move down the long stroke mode which will open the ports between the upper and lower chambers releasing the hydraulic lock;

4. start the pumps at a reduced circulating rate (low differential pressure) for six minutes, to de-activate the downhole tool or device, during which time the flow restrictor in the linear return and delay mechanism will delay closure of the ports between the upper and lower chambers of the hydraulic locking mechanism for approximately 6 to 10 minutes (the reduced pumping rate will not generate high enough differential pressure to maintain the tool or device in activated mode with the ports between the upper and lower chambers open. In these conditions the tool or device being controlled by the actuation device will move back to the de-activated position;

5. after 15 minutes at reduced circulating rate the j slot cam will have moved slowly back to the short stroke position where the ports to the upper and lower chambers are in the closed position and the j slot cam is in the short cycle mode.

The tool is now in de-activated in the locked position and will remain de activated in the locked position even with repeated pump stops and starts for single joint changes or other reasons, provided that the sequence of starting pumps and stopping them inside one minute is not repeated (in this state the j slot will cycle in the short stroke mode).

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

The invention claimed is:

1. A downhole hydraulic actuator tool for use in conjunction with a variety of downhole tools to be controlled, said downhole actuator tool configured to engage and control actuation of a downhole tool or device to be controlled, said downhole actuator tool comprising:

a body configured to be coupled to a body of an associated tool or device to be controlled, the downhole actuator tool and the associated downhole tool or device to be controlled together forming part of a tubular string for running into a bore;

an actuation member disposed in and carried by the body of said downhole actuator tool and axially moveable relative to the body, the actuation member comprising a tubular mandrel having an axial throughbore therethrough, the actuation member configured for attachment to, or to engage, an actuation mechanism of said associated tool or device to be controlled;

an actuation arrangement comprising a piston configured to move the actuation member relative to the body of said downhole actuator tool, wherein the piston is directly or operatively coupled to, or forms part of, the actuation member, wherein the downhole actuator tool is configurable between an axially retracted configuration and an axially extended configuration, the downhole actuator tool configured so that axially movement of the actuation member relative to the body of the downhole actuator tool reconfigures the downhole actuator tool from the retracted configuration to the extended configuration and applies an axial push force to the actuation mechanism of said associated tool or device and wherein axial movement of the actuation member relative to the body of said downhole actuator tool reconfigures the downhole actuator tool from the extended configuration to the retracted configuration and applies an axial pull force to the actuation mechanism of said associated tool or device; and a lock configured in a first configuration to permit movement of the actuation member by the actuation arrangement and configured in a second configuration to provide a fluid lock across the actuation member which prevents movement of the actuation member by the actuation arrangement.

2. The downhole actuator tool of claim 1, wherein the lock is configured to retain the actuation member in at least one of the retracted configuration, the extended configuration, and one or more intermediate position between the retracted configuration and the extended configuration.

3. The downhole actuator tool of claim 1, wherein the lock comprises a closed fluid system.

4. The downhole actuator tool of claim 1, wherein at least one of: the downhole actuator tool comprises at least one of a first fluid chamber and a second fluid chamber; the downhole actuator tool comprises at least one of a first fluid chamber and a second fluid chamber, at least one of the first fluid chamber and the second fluid chamber comprises an annular chamber; the downhole actuator tool comprises at least one of a first fluid chamber and a second fluid chamber, and at least one of the first fluid chamber and the second fluid chamber configured to receive a fluid; and the downhole actuator tool comprises at least one of a first fluid chamber and a second fluid chamber, and at least one of the first fluid chamber and the second fluid chamber is configured to receive a hydraulic fluid.

5. The downhole actuator tool of claim 4, wherein the lock is configured in the first configuration to permit fluid communication between the first fluid chamber and the second fluid chamber.

6. The downhole actuator tool of claim 4, comprising a fluid communication arrangement for communicating the fluid between the first fluid chamber and the second fluid chamber.

7. The downhole actuator tool of claim 6, wherein at least one of:

the fluid communication arrangement comprises at least one fluid passage or gallery;

at least part of the fluid communication arrangement is formed or otherwise provided in the body; and at least part of the fluid communication arrangement comprises a fluid conduit.

8. The downhole actuator tool of claim 4, wherein the lock comprises a valve, and wherein the valve is movable between an open condition and a closed condition to selectively permit fluid communication between the first fluid chamber and the second fluid chamber.

9. The downhole actuator tool of claim 1, wherein the lock comprises a valve.

10. The downhole actuator tool of claim 9, wherein the valve comprises at least one of:

a logic controlled control valve;

an electro-mechanical valve;

a solenoid valve; and a hydraulic valve arrangement.

11. The downhole actuator tool of claim 9, wherein the valve comprises a hydraulic valve arrangement and the hydraulic valve arrangement comprises an actuating arrangement.

12. The downhole actuator tool of claim 9, wherein wherein the valve comprises a hydraulic valve arrangement and the hydraulic valve arrangement comprises a linear return and delay arrangement.

13. The downhole actuator tool of claim 12, wherein the linear return and delay arrangement comprises at least one of:

a choke or fluid restriction device; and a non-return valve.

14. The downhole actuator tool of claim 9, wherein the valve comprises a hydraulic valve arrangement and wherein the hydraulic valve arrangement comprises a cam arrangement.

15. The downhole actuator tool of claim 14, wherein at least one of:

the cam arrangement comprises a rotating cam arrangement;

the cam arrangement comprises a j slot cam;

the cam arrangement comprises or defines a plurality of paths; and the cam arrangement comprises or defines a plurality of paths, the cam arrangement comprising or defining a short stroke and a long stroke.

16. The downhole actuator tool of claim 9, wherein the valve comprises a hydraulic valve arrangement and one of:

the hydraulic valve arrangement comprises pilot valve; and the hydraulic valve arrangement comprises pilot valve, the pilot valve comprising a spool valve.

17. The downhole actuator tool of claim 1, wherein the actuation member comprises a double acting piston.

18. The downhole actuator tool of claim 1, wherein at least one of: the downhole actuator tool is configured to activate the fluid lock in response to a selected activation event; the downhole actuator tool is configured to activate the fluid lock in response to an activation signal; and the downhole actuator tool is configured to activate the fluid lock in response to a sequence of pressure changes in a particular time interval.

19. The downhole actuator tool of claim 1, wherein at least one of:

the actuation arrangement is moveable relative to the body in response to a fluid pressure in the throughbore;

the actuation arrangement is moveable relative to the body in response to a fluid pressure in an annulus between the downhole actuator tool and a bore.

20. The downhole actuator tool of claim 1, further comprising a biasing member configured to bias the actuation member to the retracted configuration.

21. The downhole actuator tool of claim 1, wherein said actuation member of said downhole actuator tool extends axially beyond said body of said downhole actuator tool when said downhole actuator tool defines said extended configuration.

22. A method comprising: disposing a downhole actuator tool according to claim 1 in a bore; and activating the downhole actuator tool from a first configuration to a second configuration, wherein in the first configuration the downhole actuator tool permits movement of the actuation member by the actuation arrangement, and in the second configuration, the downhole actuator tool provides a fluid lock across the actuation member which prevents movement of the actuation member by the actuation arrangement.

23. The method of claim 22, wherein the downhole actuator tool is activated in response to a predetermined activation event.

* * * * *